US010553181B2

(12) United States Patent
Luo et al.

(10) Patent No.: US 10,553,181 B2
(45) Date of Patent: Feb. 4, 2020

(54) COMPENSATION METHOD AND COMPENSATION DEVICE FOR DISPLAY MODULE

(71) Applicants: BOE TECHNOLOGY GROUP CO., LTD., Beijing (CN); Beijing BOE Optoelectronics Technology Co., Ltd., Beijing (CN)

(72) Inventors: Zhenhua Luo, Beijing (CN); Hao Wu, Beijing (CN); Xuzhong Liu, Beijing (CN); Na An, Beijing (CN); Xiao Ma, Beijing (CN); Zongwei Luo, Beijing (CN); Gang Ci, Beijing (CN); Baolei Guo, Beijing (CN); Bin Xu, Beijing (CN); Shaopeng Xu, Beijing (CN); Qingzhu Guan, Beijing (CN); Zheng Zhang, Beijing (CN); Xinfeng Gong, Beijing (CN)

(73) Assignees: BOE TECHNOLOGY GROUP CO., LTD., Beijing (CN); BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 0 days.

(21) Appl. No.: 15/979,831

(22) Filed: May 15, 2018

(65) Prior Publication Data

US 2019/0035361 A1 Jan. 31, 2019

(30) Foreign Application Priority Data

Jul. 31, 2017 (CN) ..... 2017 1 0642827

(51) Int. Cl.

| | |
|---|---|
| ***G09G 5/10*** | (2006.01) |
| ***G09G 3/36*** | (2006.01) |
| ***G09G 3/00*** | (2006.01) |

(52) U.S. Cl.

CPC ..... *G09G 5/10* (2013.01); *G09G 3/3685* (2013.01); *G09G 3/3674* (2013.01);

(Continued)

(58) Field of Classification Search

USPC ..... 345/694

See application file for complete search history.

(56) References Cited

U.S. PATENT DOCUMENTS 6,240,217 B1 * 5/2001 Ercan ..... G06K 9/38 382/105
8,881,986 B1 * 11/2014 Dhua ..... G06K 7/1439 235/462.09

(Continued)

FOREIGN PATENT DOCUMENTS

CN 105575326 A 5/2016
CN 105590604 A 5/2016

(Continued)

OTHER PUBLICATIONS

First Office Action for Chinese Patent Application No. 201710642827.6 dated Oct. 31, 2018.

*Primary Examiner* — Chineyere D Wills-Burns

(74) *Attorney, Agent, or Firm* — Calfee, Halter & Griswold LLP

(57) ABSTRACT

The disclosure discloses a compensation method for a display module including: using a first group of program code to make the display module display a first greyscale value; acquiring a screen image to determine a normal display area and a poor display area; changing an output voltage for the poor display area, and recording a compensated output voltage that makes the luminance of the poor display area identical with that of the normal display area; and writing program code corresponding to the compensated output voltage into the first group of program code. The (Continued)

disclosure also discloses a compensation device for a display module.

10 Claims, 2 Drawing Sheets

(52) U.S. Cl.
CPC ..... *G09G 2320/0233* (2013.01); *G09G 2320/0686* (2013.01); *G09G 2330/02* (2013.01); *G09G 2330/12* (2013.01); *G09G 2360/145* (2013.01)

(56) References Cited

U.S. PATENT DOCUMENTS

2004/0100426 A1* 5/2004 Gaganam ..... G09G 3/22 345/75.2
2008/0068359 A1* 3/2008 Yoshida ..... G09G 3/3406 345/204
2009/0267868 A1* 10/2009 Takatani ..... B60K 35/00 345/1.3
2011/0149166 A1* 6/2011 Botzas ..... H04N 5/202 348/649
2011/0279487 A1* 11/2011 Imamura ..... G09G 3/3611 345/690
2014/0354624 A1* 12/2014 Chaji ..... G06F 1/3265 345/212
2016/0093270 A1* 3/2016 Lee ..... G09G 3/3688 345/690
2016/0104411 A1* 4/2016 Nathan ..... G09G 3/2007 345/690
2017/0185880 A1* 6/2017 Lin ..... G06K 19/06037

FOREIGN PATENT DOCUMENTS

CN 105590606 A 5/2016
CN 106328030 A 1/2017
CN 106448608 A 2/2017

* cited by examiner

COMPENSATION METHOD AND COMPENSATION DEVICE FOR DISPLAY MODULE

CROSS REFERENCE

The present disclosure claims priority to Chinese Patent Application No. 201710642827.6, filed on Jul. 31, 2017 and titled "Compensation Method and Compensation Device for Display Module", and the entire contents thereof are incorporated herein by reference.

TECHNICAL FIELD

The disclosure relates to the technical field of display, and in particular to a compensation method and a compensation device for a display module.

BACKGROUND

The display module may have various defects after its manufacture, such as bright spots, dark spots and bright lines. For example, a bright line, for example, a tailing bright line, refers to a defect that a line having luminance higher than that of the surrounding area appears on one side of the display module when the display module displays a certain greyscale. When there are these defects in the display module, the display module has to be repaired to solve the problem.

SUMMARY

According to an aspect of the present disclosure, a compensation method for a display module comprises: using a first group of program code to make the display module display a first greyscale value; acquiring a screen image to determine a normal display area and a poor display area; changing an output voltage for the poor display area, and recording a compensated output voltage that makes the luminance of the poor display area identical with that of the normal display area; and writing program code corresponding to the compensated output voltage into the first group of program code.

In some embodiments, the method further comprises: changing a greyscale value displayed by the display module, and writing program code corresponding to a compensated output voltage obtained for the display module at each greyscale value into the first group of program code.

In some embodiments, the step of acquiring a screen image comprises acquiring a screen image with an image acquisition device, and processing the acquired image to determine the luminance of the poor display area and that of the normal display area.

In some embodiments, the step of acquiring a screen image comprises: acquiring an image of the normal display area and an image of the poor display area with two image acquisition devices, respectively, to determine the luminance of the poor display area and that of the normal display area.

In some embodiments, the changing an output voltage for the poor display area comprises: gradually changing the output voltage and detecting in real time the luminance of the poor display area and that of the normal display area, and when the luminance of the poor display area is identical with that of the normal display area, recording a current compensated output voltage.

In some embodiments, when the difference between the luminance of the poor display area and that of the normal display area is less than a predetermined threshold, it is determined that the luminance of the poor display area is identical with that of the normal display area.

According to another aspect of the present disclosure, there is provided a compensation device for a display module, comprising: a driver configured to make the display module display a first greyscale value using a first group of program code; an image processing unit configured to acquire a screen image to determine a normal display area and a poor display area; and a processor configured to: change an output voltage for the poor display area, record a compensated output voltage that makes luminance of the poor display area identical with that of the normal display area, and write program code corresponding to the compensated output voltage into the first group of program code.

In some embodiments, the processor is further configured to: change a greyscale value displayed by the display module, and write program code corresponding to a compensated output voltage obtained for the display module at each greyscale value into the first group of program code.

In some embodiments, the processor is further configured to: gradually change the output voltage and detect in real time the luminance of the poor display area and that of the normal display area, and when the luminance of the poor display area is identical with that of the normal display area, record a current compensated output voltage.

In some embodiments, the processor is further configured to: determine that the luminance of the poor display area is identical with that of the normal display area when the difference between the luminance of the poor display area and that of the normal display area is less than a predetermined threshold.

BRIEF DESCRIPTION OF THE DRAWINGS

The accompanying drawings are provided for further understanding the disclosure and constitute a part of the specification, and together with the following detailed description, serve to explain the disclosure but do not constitute a limitation of the disclosure, in which.

DETAILED DESCRIPTION

To enable those skilled in the art to better understand the technical solutions of the present disclosure, a further detailed description will be made to a compensation method and a compensation device for a display module provided by the present disclosure in conjunction with the accompanying drawings and specific embodiments.

According to an embodiment of the present disclosure, the display module may be a display module known in the art or to be developed in the future. Specifically, the display module may be a self-emitting display module such as an OLED, or may also be a non-light emitting display module such as an LCD. It should be understood that the technical solutions of the present disclosure can also be applied to other forms of display modules such as projection displayers and laser displayers.

Hereinafter, the present disclosure will be described in detail by taking a liquid crystal display module as an example. Those skilled in the art should understand that the disclosed concept may be similarly applied to other types of display devices.

Figure 1:
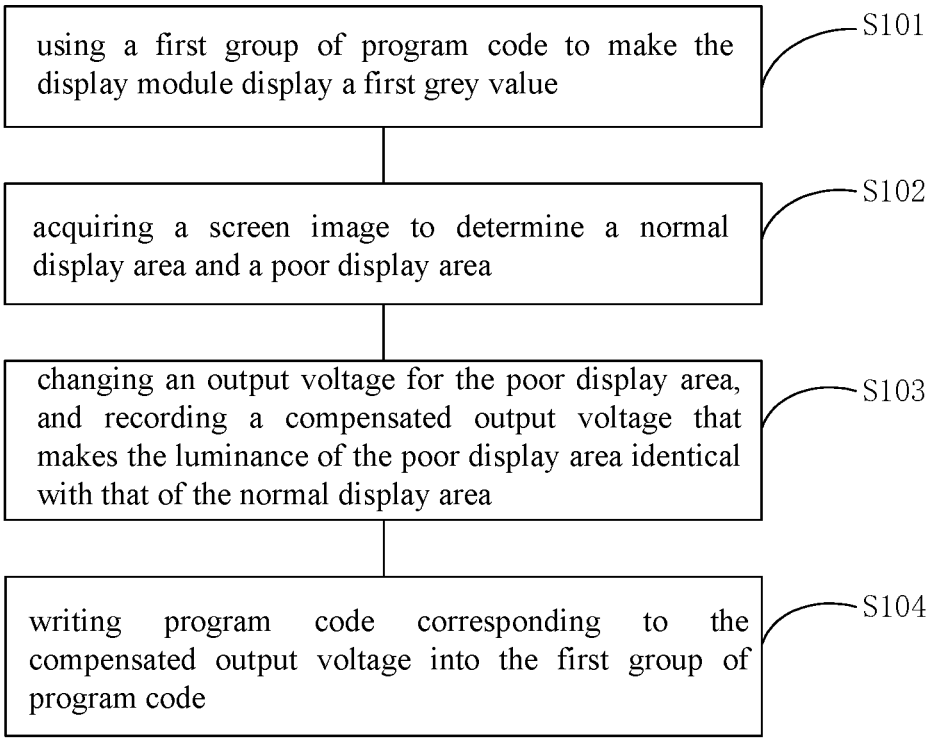
FIG. 1 is a flowchart of a compensation method for a display module according to an embodiment of the present disclosure.

FIG. 1 is a flowchart of a compensation method for a display module according to an embodiment of the present disclosure. Referring to FIG. 1, the compensation method for the display module comprises: S101: using a first group of program code to make the display module display a first grey value; S102: acquiring a screen image to determine a normal display area and a poor display area; S103: changing an output voltage for the poor display area, and recording a compensated output voltage that makes the luminance of the poor display area identical with that of the normal display area; and S104: writing program code corresponding to the compensated output voltage into the first group of program code In step S101, firstly, the first group of program code is used to make the display module display first greyscale value. In this embodiment, the first group of program code may be a group of program code that controls a driving voltage for driving each pixel in the display module. For example, the display module outputs the driving voltage corresponding to the first greyscale value to each pixel depending on the first group of program code to make each pixel emit light of predetermined luminance, so that the display module displays the first greyscale value. For a normal display module, the first group of program code may be a group of program code preset during design and/or manufacturing.

In step S102, a screen image is acquired to determine the normal display area and the poor display area. For example, an image acquisition device may be used to acquire and process the screen image to determine the luminance of the poor display area and the luminance of the normal display area. The image acquisition device may be, for example, a camera and a photosensitive device, which is not limited by the present disclosure. The image acquired by the image acquisition device may be further processed to determine the luminance of the perspective areas in the image. When an area has luminance significantly different from that of other areas, the area is determined to be a poor display area. For example, for a bright line defect, the luminance of its poor area is significantly greater than that of other areas. Therefore, when it is found that a line with luminance significantly greater than that of other areas appears in the acquired screen image, it can be determined that the area corresponding to this line is a poor display area, i.e., an area of bright line defect. Accordingly, the other areas can be determined as normal display areas. Due to the difference in luminance, there is a difference between the grey value actually displayed in the poor display area and the first grey value.

In step S103, the output voltage for the poor display area is adjusted, and a compensated output voltage that makes the luminance of the poor display area identical with that of the normal display area is recorded. Here, the output voltage for the poor display area refers to the output voltage output to the poor display area, i.e., a driving voltage for driving the pixels within the area. The compensated output voltage refers to a voltage that has been adjusted (compensated) and output to the poor display area, i.e., a driving voltage that is used to drive the pixels within the area after having been adjusted (compensated). When the output voltage is compensated such that the luminance of the poor display area is identical with the luminance of the normal display area (in this case the poor display area can display the same grey value as the first greyscale value), the current compensated output voltage is recorded.

In step S104, program code corresponding to the compensated output voltage is written in the first group of program code. After having recorded the compensated output voltage that makes the luminance of the poor display area identical with the luminance of the normal display area, the program code corresponding to the compensated output voltage may be written into the first group of program code.

Therefore, when the compensated display module is in display, the compensated first group of program code may be used to drive the display module such that when the display module displays the first grey value, the compensated output voltage is output to the poor display area depending on the compensated group of program code to allow the actual greyscale value displayed in the poor display area to be identical with the first greyscale value, thereby eliminating the poor display area and ensuring the normal display. Therefore, according to the current embodiment of the present disclosure, the display module can be driven by the compensated first group of program code, thereby eliminating the poor area on the display module and ensuring a normal display effect.

In addition, according to an embodiment of the present disclosure, similar compensation may be made for other greyscale values. For example, in the compensation method for the display module according to the present disclosure, it is also possible to change the greyscale value displayed by the display module, and write the program code corresponding to the compensated output voltage obtained for the display module at each greyscale value into the first group of program code. In this case, the poor display area of the display module at any greyscale can be eliminated, thereby further ensuring the normal display of the display module.

In the foregoing embodiment of the present disclosure, the screen image is acquired using an image acquisition device, and the image is processed to determine the luminance of the poor display area and the luminance of the normal display area. However, the present disclosure is not limited thereto. For example, in another embodiment, two image acquisition devices may be provided and allowed to separately acquire a part of the screen image, of which one image acquisition device may be used to obtain the luminance of the normal display area, and another image acquisition device may be used to obtain the luminance of the poor display area. It is possible to determine the positions of the poor display area and the normal display area by making the image acquisition device scan the displayed image. However, the present disclosure is not limited thereto, and other ways may also be used to determine the positions of the poor display area and the normal display area.

In one embodiment, changing the output voltage for the poor display area may specifically comprise: gradually changing the output voltage and detecting in real time the luminance of the poor display area and that of the normal display area, and when the luminance of the poor display area is identical with that of the normal display area, recording the current compensated output voltage. In this embodiment, since the luminance of the poor display area and of the normal display area are detected in real time as the output voltage changes, the efficiency of determining the compensated output voltage can be improved.

It should be understood that, in the present disclosure, the luminance of the poor display area being identical with the luminance of the normal display area may indicate that the luminance of the poor display area is identical with the luminance of the normal display area within a certain tolerance range. In other words, when the difference between the luminance of the poor display area and the luminance of the normal display area is less than a predetermined threshold, the influence on the display effect is reduced to a less noticeable or acceptable level, and therefore, it can be considered that the luminance of the poor display area is identical with the luminance of the normal display area. The predetermined threshold may be freely selected according to the application occasions and technical requirements of the display device, to which the disclosure does not specifically limit.

In addition, according to the present disclosure, the program code corresponding to the compensated output voltage may be burned into a driving integrated circuit (IC) of the display module. In addition, the code may comprise information of the compensated voltage and the position of the poor display area.

With the compensation method for the display module of the present disclosure, the first group of program code can be used to make the display module display the first greyscale value; the screen image is acquired to determine the normal display area and the poor display area; the output voltage for the poor display area is changed, and the compensated output voltage that makes the luminance of the poor display area identical with the normal display area is recorded; and the program code corresponding to the compensated output voltage is written into the first group of program code. Therefore, the compensated first group of program code can be used to drive the display module, thereby eliminating the poor display area on the display module and ensuring a normal display effect.

Figure 2:
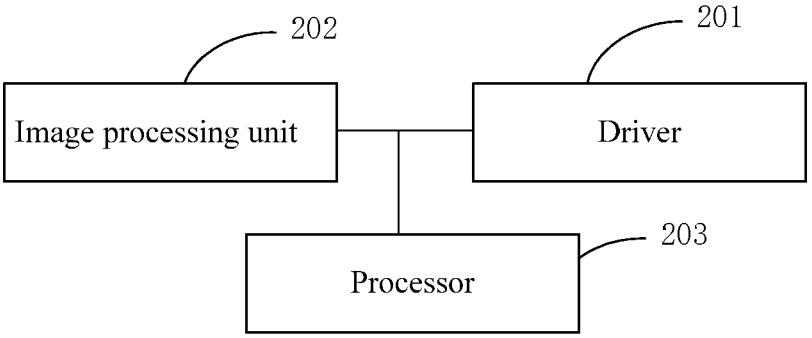
FIG. 2 is a schematic view of a compensation device for a display module according to an embodiment of the present disclosure.

FIG. 2 is a schematic view of a compensation device for a display module according to an embodiment of the present disclosure. Referring to FIG. 2, the compensation device for the display module according to the present disclosure may comprise: a driver 201 configured to make the display module display a first greyscale value using a first group of program code; an image processing unit 202 configured to acquire a screen image to determine a normal display area and a poor display area; and a processor 203 configured to: change an output voltage for the poor display area, record a compensated output voltage that makes luminance of the poor display area identical with that of the normal display area, and write program code corresponding to the compensated output voltage into the first group of program code.

The specific driving form of the driver 201 is not limited in this embodiment. For example, in one embodiment, the driver 201 may use the first group of program code to drive a scan driver and a data driver of the display module to make the display module display the first greyscale value. In another embodiment, the driver 201 may also use the first group of program code to directly apply a scan signal and a data signal to scan lines and data lines of the display module to directly drive the display module to display the first grey value. A corresponding interface may be provided on the display module to connect the driver 201 to a corresponding position in the display module.

The image processing unit 202 may comprise an image acquisition device and an image processor (not shown). The image acquisition device may be the image acquisition device described with reference to the aforementioned embodiments, which will not be described herein. In addition, the image processor may perform processing of the image to obtain luminance values of the poor display area and the normal display area.

The processor 203 may be configured to perform a method according to other embodiments of the present disclosure. For example, the processor 203 may be configured to change an output voltage for the poor display area, record a compensated output voltage that makes luminance of the poor display area identical with that of the normal display area, and write program code corresponding to the compensated output voltage into the first group of program code.

In another embodiment, the processor 203 may be further configured to: gradually change the output voltage and detect in real time the luminance of the poor display area and that of the normal display area, and when the luminance of the poor display area is identical with that of the normal display area, record a current compensated output voltage.

In yet another embodiment, the processor 203 may be further configured to determine that the luminance of the poor display area is identical with that of the normal display area when the difference between the luminance of the poor display area and that of the normal display area is less than a predetermined threshold.

The specific configuration of the processor 203 may be more clearly understood with reference to the foregoing embodiments, and will not be repeated herein.

With the compensation device for the display module of the present disclosure, the first group of program code can be used to make the display module display the first greyscale value; the screen image is acquired to determine the normal display area and the poor display area; the output voltage for the poor display area is changed, and the compensated output voltage that makes the luminance of the poor display area identical with the normal display area is recorded; and the program code corresponding to the compensated output voltage is written into the first group of program code. Therefore, the compensated first group of program code can be used to drive the display module, thereby eliminating the poor display area on the display module and ensuring a normal display effect.

Figure 3:
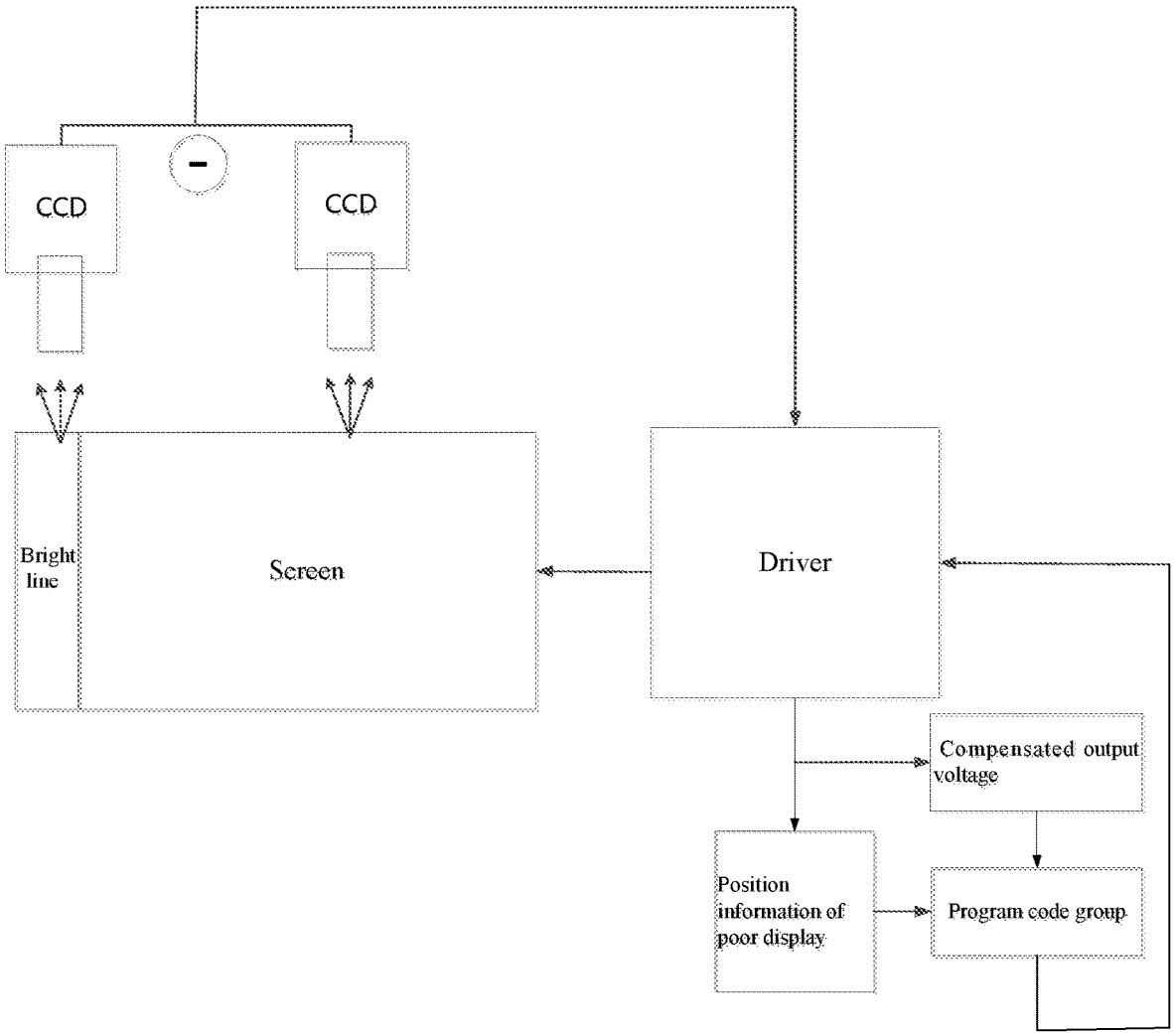
FIG. 3 shows a schematic view of operation of a compensation device for a display module for compensating a poor display on a screen according to an embodiment of the present disclosure.

Now a more detailed description will be made to a compensation device for a display module and a compensation method for a display module according to an embodiment of the present disclosure with reference to specific examples. FIG. 3 shows a schematic view of an operation of a compensation device for a display module for compensating a display defect on a screen according to an embodiment of the present disclosure.

Referring to FIG. 3, the display module (screen) has a trailing bright line defect, that is, when the display module is driven by the first group of program code and is expected to display the same grey value, an area labeled as "bright line", i.e., the poor display area, has higher luminance than other areas, i.e., the normal display areas. Here, the positions of the poor display area and the normal display area are determined by using two image acquisition devices to scan the display module, with the two CCDs being aligned with the normal display area and the poor display area, respectively.

In addition, the present disclosure is not limited thereto. For a specific display defect, since the poor display area is always located at a specific position on the screen, the previously described scanning operation is not needed, but instead, what is needed only is to make the two CCDs correspond to the specific position where the display defect appears and a position where the display defect usually does not appear, respectively. For example, for the detection of the tailing bright line, since the bright line always appears at one end of the screen, one CCD may be provided to correspond to the one end of the display module, and the other CCD may be provided to correspond to the middle area of the display module.

Next, the image acquisition devices, i.e., CCD, are used to acquire the luminance of the poor display area and the normal display area, and the two luminance values are compared with each other. In the case where the two luminance values are different, the output voltage to the poor display area is controlled to change the luminance of the poor display area. In the example of trailing bright line, in order to reduce the luminance of the bright line portion, the output voltage output to the bright line area may be reduced. The output voltage may be adjusted until the difference between the luminance of the poor display area and the luminance of the normal display area is less than a predetermined threshold, i.e., the luminance of the poor display area is considered to be identical with the luminance of the normal display area, thereby achieving compensation for the luminance of the poor display area.

Next, depending on the compensated output voltage, program code corresponding to the compensated output voltage is obtained and written into the first group of program code.

According to the present disclosure, the program code corresponding to the compensated output voltage may be burned into a driving integrated circuit (IC) of the display module. In addition, the code may comprise information of the compensation voltage and the position of the display defect.

In addition, the foregoing operation may also be repeated so as to obtain compensation voltages when the poor display area displays other greyscale values, and write the corresponding program code into the group of program code. Therefore, new program code corresponding to each greyscale value can be obtained such that when the display module is driven by the updated group of program code, the original poor display area can emit light with compensated luminance, thereby eliminating the poor display area and ensuring normal display effect.

It shall be understood that the above embodiments are merely exemplary embodiments provided for explaining the principle of the present disclosure. The present disclosure, however, is not limited thereto. For those skilled in the art, various variations and improvements may be made without departing from the spirit and essence of the present disclosure, which are also considered to be within the protection scope of the present disclosure.

What is claimed is:

1. A compensation method for a display module comprising:

using a first group of program code to make the display module display a first greyscale value;

acquiring a screen image to determine a normal display area and a poor display area;

changing an output voltage for the poor display area, and recording a compensated output voltage that makes luminance of the poor display area identical with that of the normal display area, the changing an output voltage for the poor display area comprising gradually changing the output voltage and detecting in real time the luminance of the poor display area and the luminance of the normal display area, and when the luminance of the poor display area is identical with that of the normal display area, recording a current compensated output voltage; and writing program code corresponding to the compensated output voltage into the first group of program code.

2. The compensation method according to claim 1 further comprising: changing a greyscale value displayed by the display module, and writing program code corresponding to a compensated output voltage obtained for the display module at each greyscale value into the first group of program code.

3. The compensation method according to claim 1, wherein the step of acquiring a screen image comprises acquiring the screen image with an image acquisition device, and processing the acquired image to determine the luminance of the poor display area and the luminance of the normal display area.

4. The compensation method according to claim 1, wherein the step of acquiring a screen image comprises: acquiring an image of the normal display area and an image of the poor display area with two image acquisition devices, respectively, to determine the luminance of the poor display area and the luminance of the normal display area.

5. The compensation method according to claim 1, wherein it is determined that the luminance of the poor display area is identical with the luminance of the normal display area when the difference between the luminance of the poor display area and the luminance of the normal display area is less than a predetermined threshold.

6. A compensation device for a display module, comprising:

a driver configured to make the display module display a first greyscale value using a first group of program code;

an image processing unit configured to acquire a screen image to determine a normal display area and a poor display area; and a processor configured to:

change an output voltage for the poor display area, and record a compensated output voltage that makes luminance of the poor display area identical with luminance of the normal display area, and that change an output voltage for the poor display area comprises gradually change the output voltage and detect in real time the luminance of the poor display area and the luminance of the normal display area, and when the luminance of the poor display area is identical with the luminance of the normal display area, record a current compensated output voltage; and write program code corresponding to the compensated output voltage into the first group of program code.

7. The compensation device according to claim 6, wherein the processor is further configured to: change a greyscale value displayed by the display module, and write program code corresponding to a compensated output voltage obtained for the display module at each greyscale value into the first group of program code.

8. The compensation device according to claim 6, wherein the processor is further configured to: determine that the luminance of the poor display area is identical with that of the normal display area when the difference between the luminance of the poor display area and the luminance of the normal display area is less than a predetermined threshold.

9. The compensation device according to claim 6, wherein the display module further comprises a scan driver and a data driver, wherein the driver is configured to use the first group of program code to drive the scan driver and the data driver to make the display module display the first greyscale value.

10. The compensation device according to claim 6, wherein the driver is configured to use the first group of program code to directly apply a scan signal and a data signal to scan lines and data lines of the display module to directly drive the display module to display the first grey value.

* * * * *